United States Patent [19]

Berndt et al.

[11] Patent Number: 4,614,541

[45] Date of Patent: Sep. 30, 1986

[54] METHOD OF CONTINUOUS METALLURGICAL PROCESSING OF COPPER-LEAD MATTE

[75] Inventors: Gerhard Berndt, Seevetal; Werner Marnette, Hollenstedt, both of Fed. Rep. of Germany

[73] Assignee: Norddeutsche Affinerie Aktiengesellschaft, Hamburg, Fed. Rep. of Germany

[21] Appl. No.: 766,756

[22] Filed: Aug. 16, 1985

[30] Foreign Application Priority Data

Aug. 16, 1984 [DE] Fed. Rep. of Germany ..... 3429972

[51] Int. Cl.[4] ..... C22B 15/00

[52] U.S. Cl. ..... 75/74; 75/73

[58] Field of Search ..... 75/72–77

[56] References Cited

U.S. PATENT DOCUMENTS 3,527,449 9/1970 Worner ..... 75/73

*Primary Examiner*—Peter D. Rosenberg

*Attorney, Agent, or Firm*—Karl F. Ross; Herbert Dubno

[57] ABSTRACT

A method for the continuous pyrometallurgical processing of copper-lead matte having a high lead content relative to copper. In order to ensure an economical and ecologically satisfactory processing, the following steps are performed in a continuous sequence: (a) In one processing stage a suitable atmosphere is provided and temperatures above 1250° C. and a high turbulence are maintained in a molten bath, volatile lead components are incorporated in a fine dust and liquid matte having a decreased lead content and metallic lead included in a copper-containing lead alloy are produced; (b) in another processing stage, gases which contain free oxygen are blown into or onto the liquid matte which has been produced in stage (a) and is at a temperature above 1250° C. whereby a high-oxygen converter slag and a converter copper containing less than 1% by weight lead are produced and volatilizable impurities contained in the matte are incorporated in a fine dust; and (c) in a third processing stage the converter copper, which contains less than 1% by weight Pb and other impurities, such as Ni, As, Sb, is refined in that a gas which contains free oxygen is blown into or onto the molten bath. The impurities are slagged by a selective oxidation, and a prerefined copper is formed.

3 Claims, 4 Drawing Figures

Fig.1
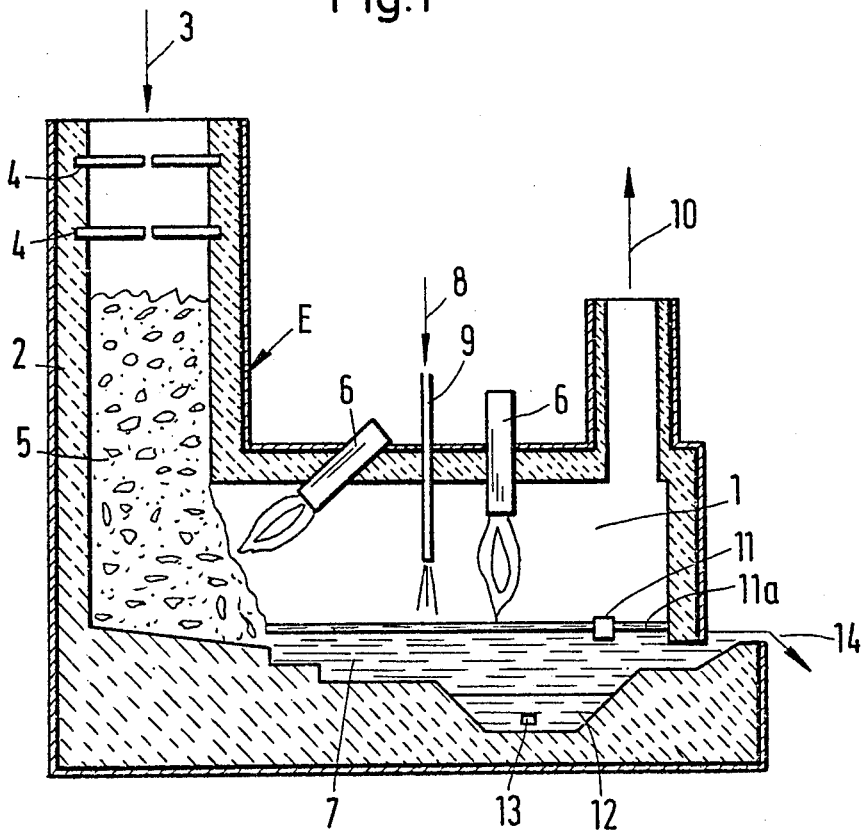
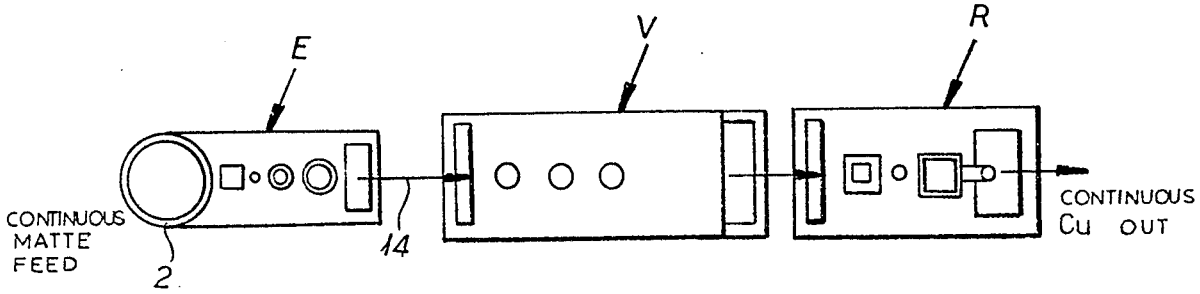
Fig.1A

METHOD OF CONTINUOUS METALLURGICAL PROCESSING OF COPPER-LEAD MATTE

FIELD OF THE INVENTION

Our present invention relates to a method of continuously processing copper-lead matte having a high lead content relative to copper.

BACKGROUND OF THE INVENTION

Copper-lead mattes are intermediate products obtained in copper and lead metallurgy. The chemical composition of such copper-lead mattes varies widely in dependence on the primary raw materials employed, e.g. within the ranges (by weight) of 15 to 50% copper, 10 to 60% lead, 0 to 30% iron, 10 to 25% sulfur. Varying amounts of arsenic, antimony, tin and nickel may also be contained in such mattes.

In the processing which is usual in the prior art, low-copper copper-lead mattes having a copper content below 35% are concentrated to copper contents of about 45% by melting them together with copper-containing materials, such as high-copper slags.

This process is usually carried out in a shaft furnace and, in addition to a more highly concentrated copper-lead matte, produces crude lead, which is subsequently refined.

The more highly concentrated copper-lead matte contains about 12 to 18% by weight lead and is subjected to a blowing treatment in Pierce-Smith converters to form converter copper. In that process mainly lead and iron are oxidized by means of atmospheric oxygen and are then taken up by a converter slag formed by an addition of silica-containing materials. Only part of the lead (about 20%) and part of other liquid materials are incorporated in the fine dust discharged from the converter.

This process has several disadvantages, including high consumption of fossil energy carriers, such as coke for the shaft furnace process, expensive preparation of the burden for the shaft furnace, formation of exhaust gases which have a low $SO_2$ content and thus cannot be used to produce sulfuric acid, distribution of the impurities of the copper-lead matte, such as lead and arsenic, to the various intermediate products formed in the shaft furnace and the converter, intermittent operation of the converter, and pollution of the environment by the emission of dust and gas adjacent to the shaft furnace and the converter.

In copper metallurgy, various other processes are known by which crude copper can be produced continuously from primary raw materials. In these processes the starting materials are copper sulfide ores or concentrates which contain impurities, such as lead, arsenic, antimony, in amounts which are very low relative to the copper content.

In all continuous processes, it is desired to achieve advantages as regards economy, energy consumption and processing technology, as well as substantial ecological improvements (*Engineering and Mining Journal,* 173 (8), pages 66 to 68; *Journal of Metals,* 16 (5), pages 416 to 420; *Journal of Metals,* 24 (4), pages 25 to 32).

Published German Application DE-OS No. 29 41 225 discloses a continuous process for the pyrometallurgical production of copper from sulfide ores or concentrates. In that process the ores are melted to produce matte and primary slag and the matte is converted to blister copper and converter slag.

To reduce the losses of copper in slags, particularly in primary slags, the melting process is carried out with a high surplus of oxygen and a matte having a relatively high copper content is obtained, the copper contained in the primary slag and in the converter slag being recovered by a reduction process.

The process is not intended for use in the processing of low-copper ores and cannot be used to process copper-lead matte having a high lead content.

In the process known from German Patent Publication DE-AS No. 19 22 599 for the production of copper from materials which contain copper sulfide, the molten bath, which contains nickel in considerable amounts, is maintained in a state of high turbulence at temperatures above 1300° C. and after part of the impurities have been volatilized is blown with an oxidizing agent and the copper sulfide is converted to liquid copper and is refined further.

In the examples of that prior publication, nickel contents up to about 14% are mentioned as well as contents up to 0.2% of each of the impurities Se, As, Bi, Pb.

In this latter process it is essential to adjust and maintain a predetermined ratio of copper to nickel so that arsenic can be effectively eliminated and the noble metals can be effectively concentrated in the metal phase, which is immiscible with the liquid matte phase. A continuous processing is not disclosed and copper-lead matte is not used.

OBJECTS OF THE INVENTION

It is an object of the invention to permit an economic processing of copper-lead mattes which have a high lead content relative to copper and to provide for that purpose a continuous process which is ecologically satisfactory.

Another object of our invention is to provide an improved process which obviates the drawbacks of prior-art processes.

SUMMARY OF THE INVENTION

The invention provides a method of continuously processing copper-lead matte containing 15 to 50% copper, 10 to 60% lead, 10 to 25% sulfur, 0 to 30% iron and usual impurities, which comprises continuously and in succession carrying out the steps of:

(a) smelting the copper-lead matte in a first processing stage operated under reducing, neutral or oxidizing conditions at a temperature in excess of 1250° C. and with a high turbulence of the resulting molten bath, to vaporize volatile lead components and, if desired, other volatilizable substances and incorporated them in a fine dust, and to produce a liquid matte containing less than 20 weight % lead and metallic lead in the form of a copper-containing lead alloy;

(b) blowing the liquid mattes with free oxygen in a gas in another second processing stage, the gas being blown into or onto the liquid matte which has been produced in step (a) and which is maintained at a temperature in excess of 1250° C., whereby a high oxygen converter slag and in coexistence therewith a converter copper having a lead content below 1 weight % are formed and the residual volatilizable impurities still contained in the matte are incorporated to a large extent in a fine dust; and (c) refining the converter copper in a third processing stage, the converter copper containing less than 1 weight % lead and also other impurities, such as nickel, arsenic, antimony, being refined in this third stage by a gas which contains free oxygen and is blown into or onto the converter copper so as to slag the impurities by a selective oxidation effected in the presence of added slag-forming substances, and a prerefined copper is produced.

The process in accordance with the invention thus comprises the continuously succeeding steps comprising melting and treating the copper-lead matte, converting the treated copper-lead matte with a blown gas, and refining the resulting converter copper.

The thermodynamic parameters which control the process steps are temperature and oxygen partial pressure. The temperature is determined by the rate at which fuel is supplied and by the heat effects of the metallurgical reactions. The required oxygen partial pressure is adjusted by the control of the ratio of fuel to oxygen. A high turbulence is effected in the bath particularly during the melting in order to improve the vaporization kinetics and/or the mass transfer.

The process in accordance with the invention results in a decisive improvement in the processing of the copper-lead matte and affords a number of advantages:

The copper-lead matte is processed continuously.

The volatilizable components contained in the copper-lead matte, particularly lead, are incorporated in a fine dust in a substantially controlled manner.

Part of the initially melted lead is removed from the process as a high-lead alloy and can be directly processed to crude lead.

Slag and intermediate products are produced at lower rates than in the conventional process.

All or part of the exhaust gases which contain $SO_2$ can be used to produce sulfuric acid.

The refined converter copper is discharged with lead contents below 0.5%, preferably below 0.2%.

The starting material used in the process in accordance with the invention consists of a copper-lead matte which contains 15 to 50% Cu, 10 to 60% Pb, 10 to 25% S, 0 to 30% Fe and usual impurities. The ratio of copper to lead is between 1:1 and 3:1, as a rule.

BRIEF DESCRIPTION OF THE DRAWING

The above and other objects, features and advantages of the present invention will become more readily apparent from the following description, reference being made to the accompanying drawing in which:

FIG. 1A is a diagrammatic plan view illustrating an apparatus for carrying out the continuous process of the invention; and FIGS. 1–3 are respective vertical longitudinal sections of the three main components of this apparatus.

SPECIFIC DESCRIPTION

Figure 2:
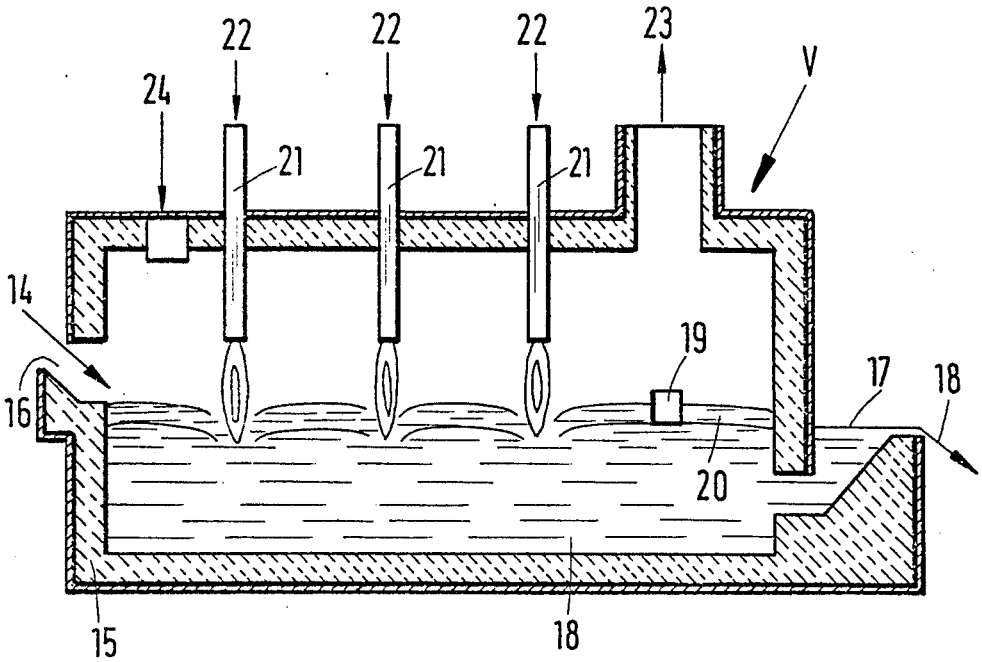

FIG. 1A shows the melting and volatilizing stage E (FIG. 1) continuously receiving the Cu - Pb matte and feeding the melt continuously to the converter stage V which feeds the raw copper to the refining stage R from which the copper is continuously discharged.

Precrushed copper-lead matte 3 composed, e.g. by weight of 42% Cu, 40% Pb, 16% S, is charged through diagrammatically shown gas-tight charging gates 4 into the shaft 2 of the melting and volatilizing furnace shown in FIG. 1.

The copper-lead matte constitutes a pile 5 of bulk material. That pile 5 rests on the bottom of the hearth furnace 1 and slopes into the hearth chamber.

By means of one or more burners 6, the copper-lead matte is melted at the slopes of the pile to constitute molten matte 7. Owing to the melting of the bulk matte adjacent to the hearth, the pile 5 of burden descends continuously so that additional crushed copper-lead matte can be continuously charged. By means of one or more burners 6 the molten matte 7 formed in the hearth space 7 is heated to temperatures above 1250° C. so that volatilizable elements, particularly lead, but also arsenic, can be volatilized. A purging gas 8 consisting, e.g., of air or inert gas, is blown into or onto the bath by purging nozzles 9 so that a high turbulence is produced in the molten material and optimum vaporization kinetics are thus obtained.

The burner or burners 6 are operated to produce a reducing, neutral or oxidizing flame. Neutral or reducing conditions in combination with an inert purging gas are used to process copper-lead matte which is free of iron. Oxidizing conditions and a neutral or oxidizing purging gas are used in the processing of iron-containing copper-lead matte composed, e.g. by weight of 46% Cu, 18% Pb, 20% S and 10% Fe.

Any slag formed during the melting operation will be tapped through the slag tap 11. In the treatment of high-iron matte, calcium oxide, e.g., in the form of limestone, will be added to the copper-lead matte to be charged so that a lime ferrite slag containing about 10 to 20 weight % CaO will be formed. Slags having such a composition have a lower dissolving power for lead and promote the volatilization of lead by increasing the activity.

In dependence on the copper, lead and sulfur contents of the molten material, a coper-containing lead alloy 12 which contains more than 50% Pb is collected in the sump of the hearth 1 and is tapped through the tap 13.

The treated copper-lead matte 14 contains about 60% by weight copper and less than 20% by weight lead flows continuously from the furnace through the matte tap and is then subjected to the blowing process.

More than 60% of the lead content of the charged copper-lead matte is vaporized and incorporated in the fine dust in the melting furnace and are entrained by the $SO_2$-containing exhaust gases 10. The resulting fine dust contains more than 45% by weight lead.

The treated matte 14 is continuously converted to converter copper by a blowing treatment in the succeeding converter V. An example of a suitable converter is shown in FIG. 2.

That converter consists of a furnace vessel 15, which has a refractory lining and constitutes a trough that is round or rectangular in cross section. The inlet opening 16 for the treated copper-lead matte 14 and the outlet opening 17 for the converter copper 18 are disposed at opposite ends of the trough. The outlet for the converter copper consists of a continuously operable siphon tap, which is not shown on the drawing. A tap opening 19 for a continuous tapping of converter slag is provided on an end face or side face at a distance from the copper tap 17.

One or more nozzles 21 are mounted in the roof or side walls of the converter and are used to blow air or oxygen-enriched air onto or into the molten material in order to effect the converting metallurgical reactions. For a volatilization of volatilizable impurities, a temperature above 1250° C. in the molten material and a high turbulence in the bath are required.

During steady-state continuous operation, the volume rate of the blast 22 and the rate at which the matte 14 is supplied from the melting furnace are so matched that a converter copper containing less than 1% lead is continuously discharged from the converter. For that purpose the resulting converter slag must have a copper to lead mass ratio of at least 1. This means that part of the copper must be oxidized.

The process is carried out in such a manner and the rate at which oxygen is supplied in the blast 22 is so selected that a high-oxygen liquid slag 20 is formed in the converter in coexistence with the converter copper 18. Adjacent to the matte inlet that slag is reacted with the matte 14, which is continuously supplied.

In a simplfied representation, the following reactions are carried out spontaneously:

(a) $Cu_2S$ (matte)+20 (slag)=2 Cu (metal)+$SO_2$ (b) PbS (matte)+30 (slag)=PbO (fine dust)+$SO_2$
PbS (matte)+20 (slag)=Pb (fine dust)+$SO_2$ The evolution of gaseous $SO_2$ results in a high turbulence in the molten material in the region in which the reaciton is effected so that the reaction and vaporization kinetics are influenced in a desirable manner.

This spontaneous reaction prevents an incorporation of the lead content of the matte 14 in the converter copper. Instead, the spontaneous reaction of matte to slag results in a rapid vaporization of the residual lead, most of which is incorporated in the fine dust from the converter. Together with the lead, other volatilizable substances are discharged with the fine dust.

The fine dust from the converter is entrained by the high-$SO_2$ exhaust gas 23 and is separated from the gas stream in an exhaust gas purifier.

The blast which is required for the reactions is directed from nozzles onto the molten material with a high kinetic energy at right angles or at an oblique angle to the surface of the bath. Alternatively, the blast can be injected directly into the metal bath through nozzles disposed under the bath.

The conditions for the volatilization in the converter can be improved by an addition of lime 24 for forming a lime-containing converter slag.

The resulting converter copper 18 still contains less than 1% by weight lead in addition to other impurities. In a refining furnace R, which succeeds the converter V, that converter copper is refined to lead contents below 0.2%.

Figure 3:
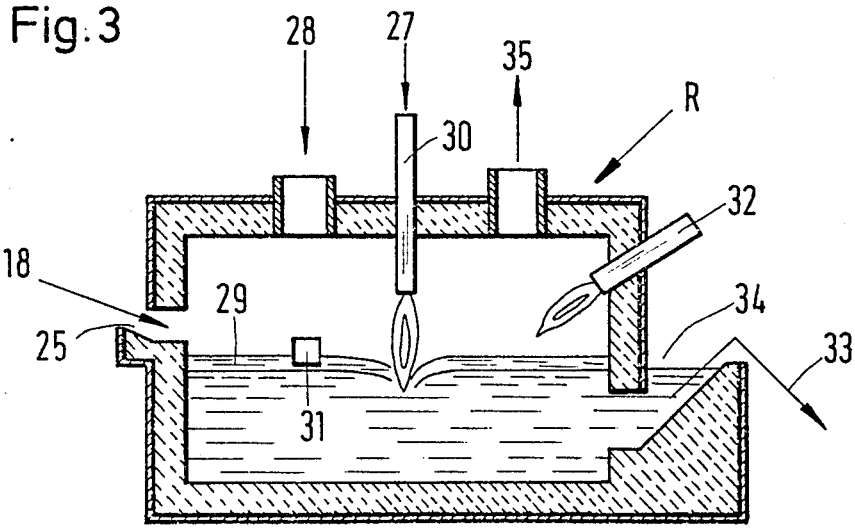

An example of a suitable refining furnace is shown in FIG. 3.

In that furnace, impurities contained in the copper, such as lead and antimony, are partially oxidized with air or oxygen-enriched air 27 and the resulting oxides are separated as slag with the aid of slag-forming constituents. The slag which is formed suitably contains silica. The refining can be distinctly improved by a slag which contains suitable additives, such as boron oxide, because this will reduce the activity of the impurities contained in the slag.

The slag 29 which has been formed can be treated in a separate reduction process, in which the incorporated impurities, such as lead, antimony, are reduced, and a lead alloy is formed, so that the slug is again available as a refining slag 28 for refining the converter copper 18.

The converter copper 18 is treated continuously. The air 27 required to oxidize the impurities which are contained in the copper 18 is blown through top-blowing lances 30 onto the molten material. The resulting slag 29 flows out of the refining furnace through the tap 31. The refined converter copper 33 leaves the furnace through a tap 34. Heat losses are compensated in that the refining furnace is heated by the burner 32.

The invention relates also to a plant for carrying out the method in accordance with the invention. A suitable plant includes the furnace units E, V and R which are shown in FIGS. 1 to 3 and are interconnected by suitable means for ensuring a continuous flow of material between the furnaces. In accordance with the above the plant in accordance with the invention comprises the following units:

A melting unit E comprising a shaft section 2 and a hearth section 1 connected to the shaft section, also means 4 for a continuous supply of the copper-lead matte 3 to be melted, at least one burner 6, means 6, 9 for a continuous, controlled supply of fuel, of gas which contains free oxygen, and of purging gas, and means 10, 11, 13 for a separate withdrawal of treated molten matte 14, slag 11*a*, copper-containing lead alloy 12 and exhaust gas 10;

a converter V for converting treated molten matte 14 to converter copper by a blowing process, comprising means 16 for supplying molten matte 14 from the melting unit E and for supplying reactants 22, 24 and openings 17, 19 for a separate withdrawal of liquid converter copper 18, liquid converter slag 20 and exhaust gas 23; and a refining furnace R for refining the converter copper, comprising means 25, 28, 30 for supplying liquid converter copper 18 and reactants, such as gases that contain free oxygen, slag or slag-forming materials, and openings 31, 34 for a separate withdrawal of refining slag 29, refined converter copper 33 and exhaust gas 35.

We claim:

1. A method for continuously processing copper-lead matte containing by weight 15 to 50% copper, 10 to 60% lead, 10 to 25% sulfur, 0 to 30% iron and usual impurities, which comprises continuously and in sequence carrying out the steps of:

(a) smelting and treating said copper-lead matte in a first processing stage under reducing, neutral or oxidizing conditions, at temperatures in excess of 1250° C. to produce a molten bath and maintaining said bath under high turbulence to vaporize volatile lead and incorporate it in a fine dust, and to produce liquid matte containing less than 20% by weight lead as well as metallic lead in the form of a copper-containing lead alloy such that:

when the copper-lead matte contains iron, the iron is oxidezed and CaO-containing substances are added so that the oxidized iron is incorporated in a lime ferrite slag which contains about 10 to 20% by weight CaO, and when the copper-lead matte has a low iron content, a fuel is burned to melt and overheat the copper-lead matte with a neutral or reducing flame, and turbulence in the bath for the volatilization of impurities is produced by blowint the bath with an inert gas;

(b) at a location spatially separated from that of step (a) and subsequent thereto blowing said liquid matte with a gas containing free oxygen in a second processing stage while said liquid matte is maintained at a temperature in excess of 1250° C., to form a high-oxygen converter slag and in coexistence therewith a converter copper having a lead content below 1% by weight and residual volatilizable impurities still contained in the matte are incorporated in a fine dust; and (c) refining said converter copper, which contains less than 1% by weight lead and arsenic and antimony impurities in a third processing stage by blowing it with a gas which contains free oxygen so as to slag the impurities by a selective oxidation effected in the presence of an added slag-forming substance, thereby producing a prerefined copper.

2. The method defined in claim 1 wherein the melting in the first stage is controlled to produce a partially deleaded matte having a composition which corresponds to miscibility gap existing in the system copper-lead-sulfur phase system and a coexisting metallic alloy containing lead in excess of 50% by weight, and the two phases are separately withdrawn.

3. The method defined in claim 1 wherein an oxide selected from the group consisting of $SiO_2$ and $B_2O_3$ is added to the slag formed during the refining of the converter copper in the third operating stage.

* * * * *